United States Patent [19]

Dawson

[11] 4,213,473

[45] Jul. 22, 1980

[54] AFRO OIL COMB

[76] Inventor: Oscar E. Dawson, 2224 16th Ave., Sacramento, Calif. 95822

[21] Appl. No.: 823,270

[22] Filed: Aug. 10, 1977

[51] Int. Cl.[2] ..... A45D 24/22

[52] U.S. Cl. ..... 132/113

[58] Field of Search ..... 132/113, 112, 114–116, 132/9, 11, 140, 149

[56] References Cited

U.S. PATENT DOCUMENTS

| | | | |
|---|---|---|---|
| 563,112 | 6/1896 | Wilson | 132/140 |
| 804,522 | 11/1905 | Delory | 132/112 |
| 1,852,362 | 4/1932 | Newby | 132/149 |
| 2,293,634 | 8/1942 | Sluss | 132/113 |
| 2,336,717 | 12/1943 | Crimmins | 132/112 X |
| 2,381,048 | 8/1945 | Habostad | 132/113 |
| 2,582,533 | 1/1952 | Dixon | 132/116 |
| 2,624,348 | 1/1953 | Matson | 132/114 |
| 3,520,311 | 7/1970 | Iesersek et al. | 132/111 |
| 3,754,557 | 8/1973 | Moore | 132/114 |
| 4,044,724 | 8/1977 | Merchill | 132/112 |

*Primary Examiner*—G. E. McNeill

*Attorney, Agent, or Firm*—Blair, Brown & Kreten

[57] ABSTRACT

Disclosed herein is a means for providing oil commonly used as a hair dressing, to be disposed on a person's head simultaneously with combing ones hair. This is possible by providing a comb having hollow teeth and an oil reservoir or chamber as well as means for controlling the volume of hair dressing oil that is to be deposited.

1 Claim, 3 Drawing Figures

AFRO OIL COMB

BACKGROUND OF THE INVENTION

FIELD OF THE INVENTION

The following invention relates generally to an oil comb which automatically dispenses a quantity of hair dressing simultaneously with the combing of ones head. For many people, dry hair and its associated problems, namely a dry, itchy scalp and hair that is brittle to the extent that it splits must provide lubrication not only to eliminate this dryness, but also to make their hair managerable. Since must of these oil preparations are not readily soluble in water, applying the hair dressing manually prior to grooming is undesirable since the users hands become oily and have to be washed. Accordingly the following detailed description of this invention eliminates the problems associated with dry hair, dry scalp, etc. and provides a means for dispensing oil simultaneously with grooming ones hair while eliminating the associated oilyness on ones hands.

Accordingly, it is an object of this invention to provide a hair lubricating mechanism which dispenses a hair dressing preparation simultaneously with the combing operation.

It is a further object of this invention to provide such a comb of the character described above which can control the amount of lubrication which is to be deployed.

Other objects and advantages will become apparent in the following specification when considered in light of the attached drawings.

DESCRIPTION OF THE PREFERRED EMBODIMENT

Figures 1, 2, 3:
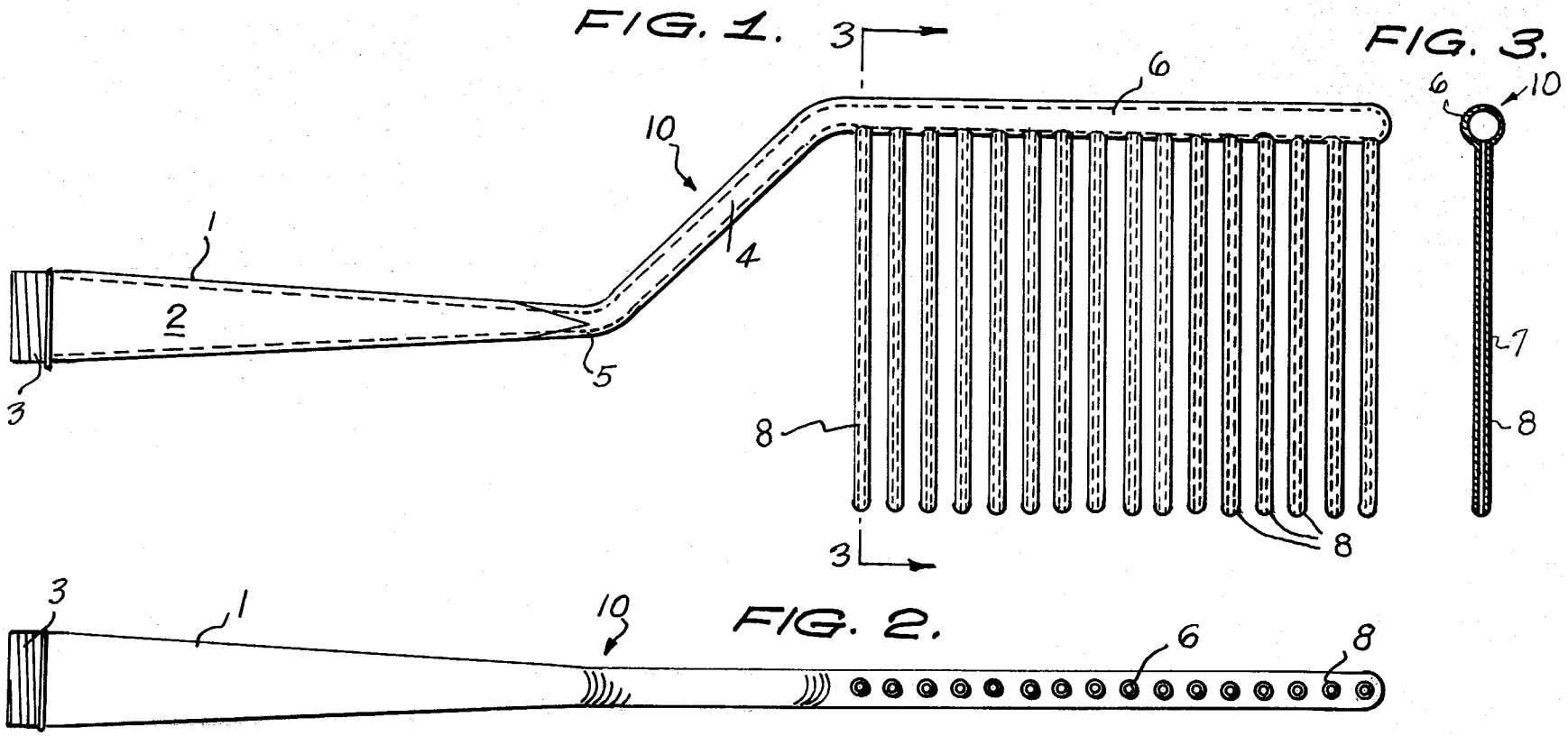
FIG. 1 shows a side view of the oil comb of the instant invention.
FIG. 2 is a bottom view of the comb shown in FIG. 1 looking up.
FIG. 3 is a sectional view taken along lines 3—3 of FIG. 1.

Referring to the drawings now, in which like reference numerals refer to like parts throughout the various drawings, reference numeral 10 generally denotes the oil comb assembly.

The oil comb 10 has a handle 1 in which there is disposed a cavity 2 which serves as a reservoir for holding the hair dressing oil preparation. One extremity of this handle is provided with a filler cap having in the preferred embodiment a threaded cap 3 disposed on complementally formed threads of handle 1.

The other extremity of handle 1 and the inner passage 2 of said handle is provided with a tapered type valve 5 which serves as a restriction device its function will be described hereinafter. Communicating with this restrictive device 5 is an upwardly extending channelway 4 which is in further communication with the passageway 6 which is parallel to the main body of the handle 1 but offset therefrom. Extending from this channel 6 and extending downwardly therefrom are a plurality of teeth 8 all of which have a hollow configuration so that oil which is stored in chamber 2 of handle 1 can extend and traverse off set passageway 4, channel 6 and through the teeth of the comb 8 through the appropriate hollow area denoted by numeral 7 best seen in FIG. 3.

It is to be noted that the handle 1 is suitably disposed and orthogonal to the plurality of teeth which form the main body of the comb substantially at the mid-point of these teeth, thereby providing a good balance when using the comb. The restrictive valve 5 has the affect of allowing a person to moderate the amount of oil to be dispensed through the teeth of the comb by varying the amount of pressure applied on the handle 1. It is to be noted that the material that handle 1 is comprised of is resilient and has a memory which will cause the handle to return to its original shape after depressing the handle to dispense fluid through the passageways 4 and 6 and 7 which operates against the restrictive orifice 5. That is to say, when one consciously depresses the handle 1 a quantity of oil is dispensed through restrictive orifice 5 then forward through passageways 6 and 7 to provide the necessary lubrication. However after the lubrication has been dispensed to a sufficient degree lightening the pressure on the handle will cause the handle to assume its original conical configuration and the restrictive valve 5 tends to discourage any further oil being pumped through the teeth so that grooming can be continued by using the comb without the further disposition of oil on the person's head.

When the oil reservoir has been emptied, the comb can be refilled by means of a cap screw 3 disposed at the extremity remote from the teeth. Further it is important to note that since the handle is diposed substantially at the mid-points of these teeth a good balance is effected and the comb is easy to use.

Having thus described the preferred embodiment of the invention it should be understood that numerous structural modifications and adaptations may be resorted to without departing from the spirit of the invention.

What is claimed is:

1. A comb for dispensing a controllable amount of oil to the hair of the user comprising in combination: a conically tapering hollow handle having a threaded end cap at a larger extremity of said handle and a valve closure at a narrower extremity within the hollowing of said handle, said handle is fashioned from deformable, resilant material having a memory to return to an original non-stressed condition, whereby when said handle is squeezed, said valve is opened and when said handle is not squeezed, said valve is closed, a first hollow passageway communicating with said valve, downstream thereof and upwardly angulated relative to an axial extent of said handle, a second tubular passageway connected to said first passageway at the extremity remote from said valve, said second passageway disposed parallel to, but away from said handle, a plurality of hollow teeth extending downwardly from said second passageway crossing substantially medially over an extended axial line generated from said handle, said teeth provided with openings at their extremities remote from said second passageway so that a further line extending to said teeth extremities from the terminal portion of said handle at its juncture with said first hollow passageway defines an isosceles triangle with the equal sides being said further line and said first hollow passageway and the base being the tooth nearest the handle whereby a liquid disposed on said handle can be dispensed through said teeth and the upward angulation of said first passageway and the medial disposition of said teeth relative to the extended axial line provide a balanced comb.

* * * * *